US006049050A

United States Patent [19]

David

[11] Patent Number: 6,049,050

[45] Date of Patent: Apr. 11, 2000

[54] MEDIUM OR HIGH VOLTAGE CIRCUIT BREAKER INCLUDING A TRANSMISSION BELT LOOPED AROUND TWO WHEELS

[75] Inventor: Renaud David, Chuzelles, France

[73] Assignee: Alsthom T & D SA, Paris, France

[21] Appl. No.: 09/241,072

[22] Filed: Feb. 1, 1999

[30] Foreign Application Priority Data

Feb. 2, 1998 [FR] France ..... 98 01133

[51] Int. Cl.[7] ..... H01H 3/00; H01H 3/24; H01H 3/32; H01H 33/02; H01H 33/34

[52] U.S. Cl. ..... 218/154; 218/45; 218/78

[58] Field of Search ..... 218/59, 62–63, 218/84, 57, 43, 45, 154, 78, 140, 120

[56] References Cited

U.S. PATENT DOCUMENTS

| | | | |
|---|---|---|---|
| 4,649,243 | 3/1987 | Thuries | 218/154 |
| 4,973,806 | 11/1990 | Kirchesch et al. | 200/148 F |
| 5,578,806 | 11/1996 | Hofbauer et al. | 218/59 |
| 5,905,243 | 5/1999 | Zehnder et al. | 218/154 |

FOREIGN PATENT DOCUMENTS

| | | |
|---|---|---|
| 0 809 269 A2 | 11/1997 | European Pat. Off. . |
| 004535 | 1/1992 | Japan . |

*Primary Examiner*—Lincoln Donovan
*Attorney, Agent, or Firm*—Sughrue, Mion, Zinn, Macpeak & Seas, PLLC

[57] ABSTRACT

Within an envelope, the medium or high voltage circuit breaker includes first and second main contacts that are movable relative to each other along a common axis, first and second arcing contacts that are movable along the common axis, the first arcing contact being secured to the first main contact, and a device for transmitting displacement to the second arcing contact in a direction opposite to the displacement of the first main contact and the first arcing contact. The device includes two wheels mounted in fixed positions in the circuit breaker and in alignment on the common axis, and a transmission belt looped around the two wheels, thereby enabling the second arcing contact to be displaced relative to the first contacts by means that occupy little space.

6 Claims, 2 Drawing Sheets

MEDIUM OR HIGH VOLTAGE CIRCUIT BREAKER INCLUDING A TRANSMISSION BELT LOOPED AROUND TWO WHEELS

The present invention relates to a medium or high voltage circuit breaker which comprises, in an envelope, first and second main contacts that are movable relative to each other along a common axis, first and second arcing contacts that are movable along the common axis, the first arcing contact being secured to the first main contact, and means for transmitting displacement to the second arcing contact in a direction opposite to the displacement of the first main contact and the first arcing contact.

BACKGROUND OF THE INVENTION

Such a circuit breaker is known, in particular from European patent application EP 0 313 813 published on May 3, 1989. The first main contact and the first arcing contact are secured to a first rack which co-operates with a pinion mounted in a fixed position in the circuit breaker and rotatable about an axis that is perpendicular to the common axis. The second arcing contact is formed by a rod in which a second rack is inserted that meshes with the pinion at a contact point that is diametrically opposite its contact point with the first rack.

During opening of the circuit breaker, conventional control means drive the first main contact and the first arcing contact along the common axis in a direction such that the first main contact separates from the second main contact which is stationary in the circuit breaker. The second arcing contact is simultaneously displaced in the opposite direction by means of the two racks and the pinion, so as to be separated from the first arcing contact. Provision is also made to double up the pinion and the above two racks, placing them on both aides of the common axis so as to balance the transmission forces applied to said elements when opening the circuit breaker.

The pinions and the racks that enable displacement to be transmitted to the second arcing contact in a direction that is opposite to the displacement of the first main contact and the first arcing contact are disposed inside the second main contact which is cylindrical, and they give rise to a problem of bulk. The use of pinions and racks has also turned out to be relatively expensive, given the need to make the gear teeth of those elements.

OBJECTS AND SUMMARY OF THE INVENTION

The object of the invention is to reduce the size of the circuit breaker and to reduce its manufacturing cost.

To this end, the invention provides a medium or high voltage circuit breaker which comprises, in an envelope, first and second main contacts that are movable relative to each other along a common axis, first and second arcing contacts that are movable along the common axis, the first arcing contact being secured to the first main contact, and means for transmitting displacement to the second arcing contact in a direction opposite to the displacement of the first main contact and the first arcing contact, wherein said means comprises two wheels mounted in fixed positions inside the circuit breaker and being in alignment on the common axis, and a transmission belt which is looped around the two wheels.

The two wheels in alignment on the common axis of the circuit breaker, and around which the looped transmission belt is mounted enable the second arcing contact to be displaced relative to the first contacts while requiring a reduced amount of space, and they constitute elements that are less expensive to make than racks.

It is also possible to use a transmission chain looped over two sprocket wheels, or a cable looped over two pulley wheels.

BRIEF DESCRIPTION OF THE DRAWINGS

Other characteristics and advantages of the invention appear on reading the following description of two embodiments of the invention as shown in the drawings.

MORE DETAILED DESCRIPTION

Figure 1A:
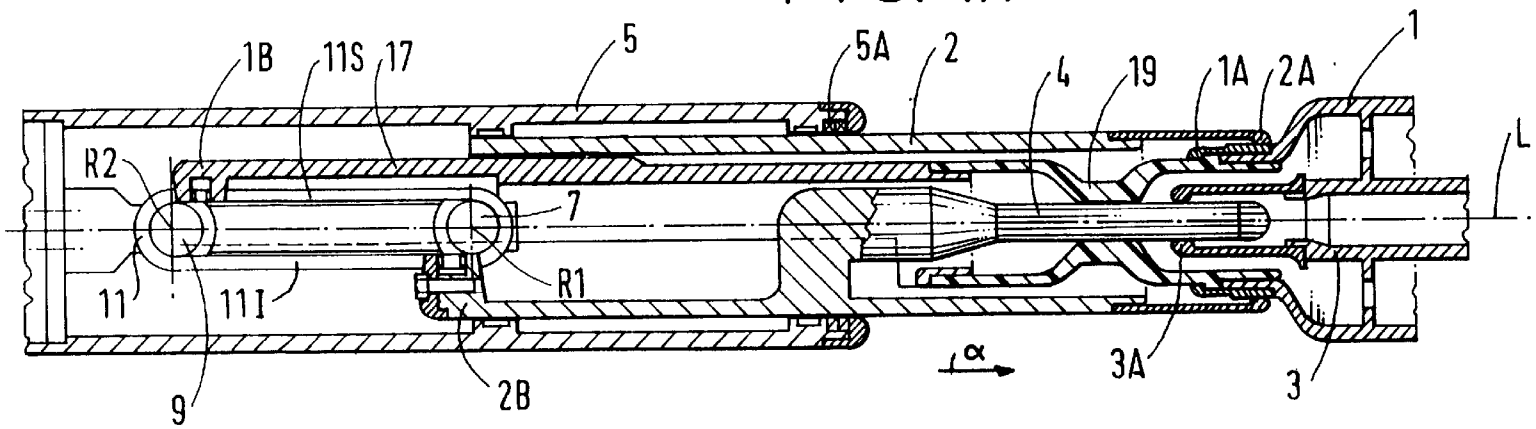
FIGS. 1*a* and 1*b* are longitudinal sections showing a circuit breaker constituting a first embodiment of the invention respectively in its closed position and in its open position.

A medium or high tension circuit breaker as shown in FIGS. 1 and 2, comprises first and second main contacts 1 and 2 which extend along a common axis L inside an envelope (not shown) and which are movable along said axis.

The second main contact 2 (FIGS. 1*a* and 2*a*) carries contact fingers 2A which form a thimble that exerts contact pressure on a portion 1A of the first main contact 1. When the circuit breaker is closed, electricity passes permanently between the two main contacts 1 and 2 via a fixed and cylindrical part 5 which extends parallel to the common axis L and inside which the second main contact 2 slides via a sliding contact 5A.

As shown in FIGS. 1 and 2, the circuit breaker also comprises first and second arcing contacts 3 and 4. The first arcing contact 3 is in the form of a hollow cylinder extending parallel to the common axis L and movable in translation parallel to said axis, being secured to the first main contact 1. The second arcing contact 4 is in the form of a rod extending along the common axis L of the circuit breaker and movable along the common axis L, being secured to the second main contact 2. The first arcing contact 3 carries contact fingers 3A forming a thimble which exerts contact pressure on the rod of the second arcing contact 4 to enable electricity to pass in transient manner during a stage in which the circuit breaker is being opened, and following separation of the main contacts 1 and 2.

According to the invention, two wheels 7 and 9 are mounted inside the circuit breaker in fixed positions that are in alignment on the common axis L. These two wheels are movable in rotation about respective axes R1 and R2 that are perpendicular to the common axis L. A transmission belt 11 is looped around the two wheels 7 and 9 which are located inside the fixed and cylindrical part 5 without requiring its diameter to be increased.

Figure 1B:
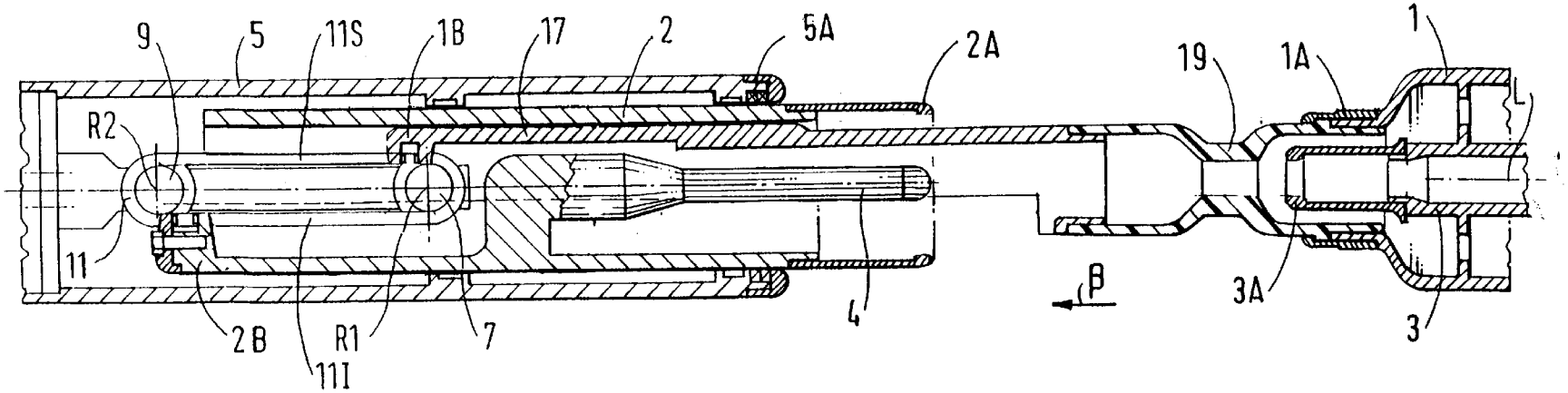

In a first embodiment of the invention, as shown in FIGS. 1*a* and 1*b*, the second main contact 2 engages the transmission belt 11 via a bottom clamp 2B, and the first main contact 1 engages the transmission belt 11 via a top clamp 1B. The top clamp 1B is fixed to one end of a half-tube 17 which is secured to the first main contact 1 via a blast nozzle 19. The terms "bottom" clamp 2B and "top" clamp 1B are used respectively to mean a clamp engaging a first rectilinear segment 11I of the transmission belt 11 disposed on a first side of the common axis L, and a clamp engaging a second rectilinear segment 11S of the transmission belt 11 disposed on a second side of the common axis L, symmetrically relative to the first side.

To open the circuit breaker, the first main contact 1 is displaced by conventional control means (not shown) in the direction given by arrow α in FIG. 1*a*. The movement in translation of the first main contact 1 is transmitted by the transmission belt 11 and the top and bottom clamps 1B and 2B to the second main contact 2 which moves simultaneously in a direction opposite to that of the first main contact 1, referenced β in FIG. 1*b*, for the purpose of interrupting the main flow of electricity. The first and second arcing contacts 3 and 4 which are respectively secured to the first main contact 1 and to the second main contact 2 are driven in displacement in respective opposite directions α and β so as to separate after the two main contacts 1 and 2 have separated, thereby interrupting the transient flow of electricity.

Figure 2A:
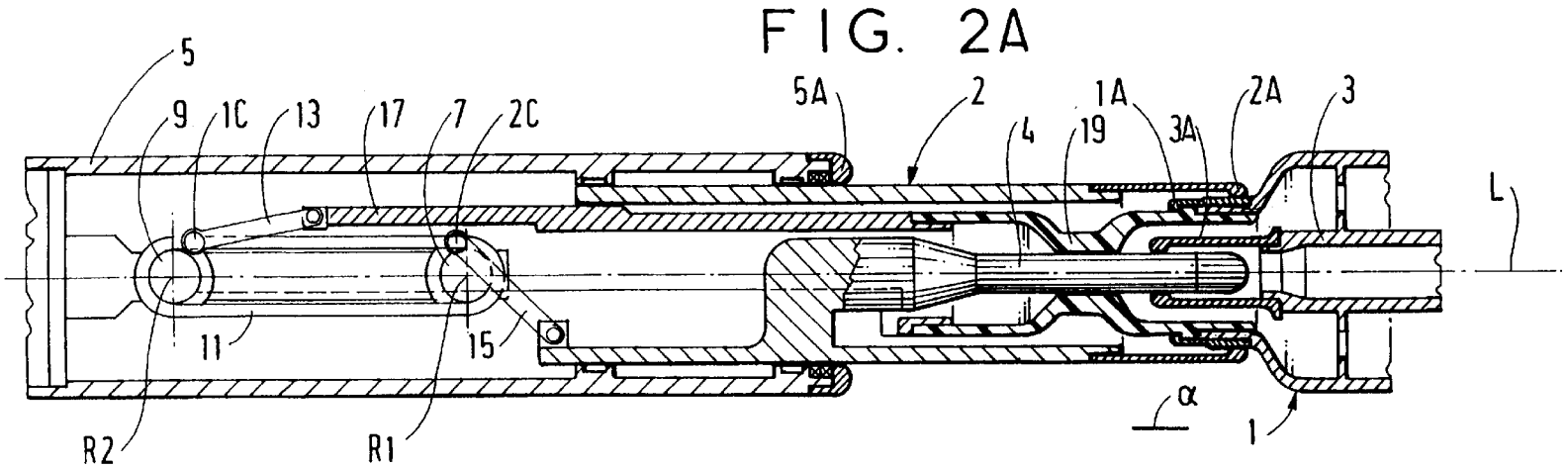
FIGS. 2*a* and 2*b* are longitudinal sections showing a circuit breaker constituting a second embodiment of the invention respectively in its closed position and in its open position.
Figure 2B:
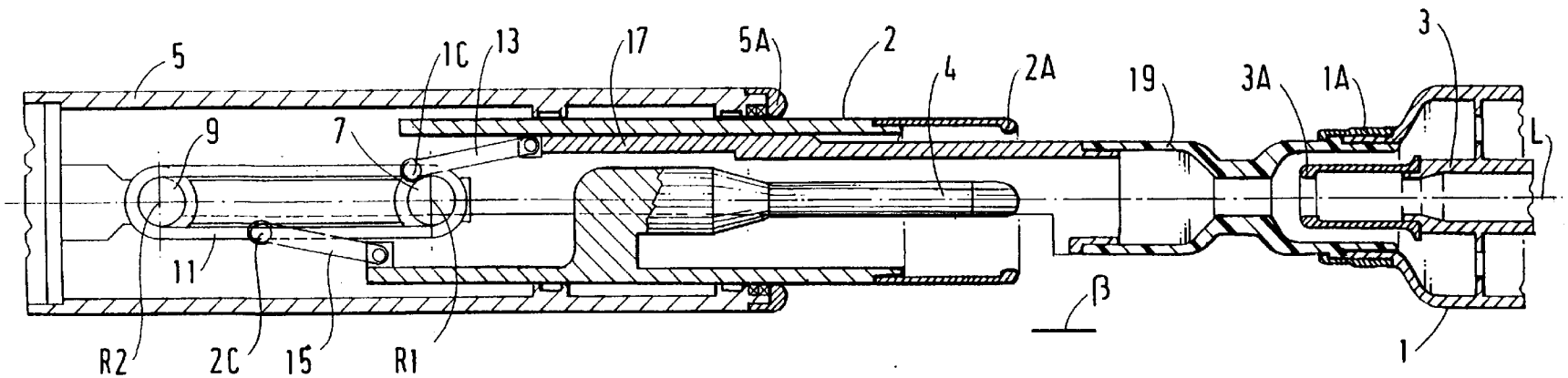

In the second embodiment of the invention as shown in FIGS. 2*a* and 2*b*, the first main contact 1 engages the transmission belt 11 via a first link 13 having one end hinged to the half-tube 17 secured to the blast nozzle 19, and the second main contact 2 engages the transmission belt 11 via a second link 15. The links 13 and 15 are secured to the transmission belt 11 via pins 1C and 2C that enable the links to rotate in a plane that is perpendicular to the axes of rotation R1 and R2 of the two wheels 7 and 9.

To open the circuit breaker, the first main contact 1 is displaced in the direction given by arrow α in FIG. 2*a*, by using conventional control means (not shown). The translation movement of the first main contact 1 is transmitted by the transmission belt 11 and the links 15 and 13 to the second main contact 2 which is displaced in the opposite direction to the first main contact 1, referenced β in FIG. 2*b*, to interrupt the permanent flow of electricity. The first and second arcing contacts 3 and 4 respectively secured to the first main contact 1 and to the second main contact 2 are respectively driven in displacement in the two opposite directions α and β so as to separate after the two main contacts 1 and 2 have separated so as to interrupt the transient electricity flow.

In this second embodiment of the invention, it is advantageous to fix the pins 1C and 2C to the transmission belt 11 at a distance from each other such that the pin 1C for the first link 13 drives the transmission belt 11 while performing a stroke in translation between the two wheels 7 and 9, and while simultaneously the pin 2C of the second link 15 is driven by the transmission belt 11 to perform a semicircular stroke in rotation around a wheel 7 followed by a stroke in translation between the two wheels 7 and 9. While the pin 2C of the second link 15 is performing a semicircular stroke in rotation around a wheel 7, the main and arcing second contacts 2 and 4 hardly move, thereby imparting a degree of freedom to the circuit breaker for adjusting synchronization of the subsequent separation of the arcing contacts relative to the separation of the main contacts.

I claim:

1. A medium or high voltage circuit breaker, comprising:

a first set of contacts and a second set of contacts that are movable relative to each other along a common axis; and means for transmitting displacement to the second set of contacts in a direction opposite to a displacement of the first set of contacts, wherein said transmitting means includes two wheels aligned on the common axis so that a center axis of each of said wheels is positioned on the common axis and mounted to rotate about two respective fixed axes extending perpendicularly to said common axis, and a transmission belt looped around the two wheels to define two rectilinear belt segments, the first set of contacts being connected to move with one of the two belt segments and the second set of contacts being connected to move with the other belt segment.

2. A circuit breaker according to claim 1, wherein each of said first and second sets of contacts is connected to move with its respective belt segment by means of a clamp respectively secured to each of said first and second sets of contacts for engaging the respective belt segment.

3. A circuit breaker according to claim 1, wherein each of said first and second sets of contacts is linked to move with its respective belt segment by a link, and wherein each link has one end fixed to the respective set of contacts and its other end fixed to the respective belt segment by means of a pin.

4. A circuit breaker according to claim 1, in which the transmission belt is a chain.

5. A circuit breaker according to claim 1, in which the wheels are two pulley wheels, and the transmission belt is a cable.

6. A medium or high voltage circuit breaker, comprising:

a first set of contacts and a second set of contacts that are movable relative to each other along a common axis;

two wheels aligned on the common axis so that a center axis of each of said wheels is positioned on the common axis; and a transmission belt looped around said wheels, wherein the first and second set of contacts are connected to said belt, so that the first set of contacts and second set of contacts are displaced in opposite directions, with respect to each other, by movement of said belt.

* * * * *